US005173036A

United States Patent [19]

Fladby

[11] Patent Number: 5,173,036

[45] Date of Patent: Dec. 22, 1992

[54] METHOD AND AN ARRANGEMENT FOR CONTROLLING A LINEAR MOTOR

[75] Inventor: Tron-Halvard Fladby, Nittedal, Norway

[73] Assignee: Speeder, A.S., Nittedal, Norway

[21] Appl. No.: 768,312

[22] PCT Filed: Mar. 30, 1990

[86] PCT No.: PCT/NO90/00058

§ 371 Date: Oct. 4, 1991

§ 102(e) Date: Oct. 4, 1991

[87] PCT Pub. No.: WO90/12197

PCT Pub. Date: Oct. 18, 1990

[30] Foreign Application Priority Data

Apr. 6, 1989 [NO] Norway ..... 891427

[51] Int. Cl.[5] ..... F04B 9/12

[52] U.S. Cl. ..... 417/403; 91/313

[58] Field of Search ..... 417/403, 404, 397; 91/313

[56] References Cited

U.S. PATENT DOCUMENTS

| | | | |
|---|---|---|---|
| 2,361,757 | 10/1944 | Fink | 91/313 X |
| 2,731,953 | 1/1956 | Scott | 121/157 |
| 2,751,889 | 6/1956 | Mohler | 417/397 |
| 3,071,118 | 1/1963 | Wilden | 91/313 X |
| 3,272,081 | 9/1966 | Vedoer | 91/313 X |
| 3,374,713 | 3/1968 | Broughton | 91/313 X |
| 3,740,960 | 6/1973 | Erma | 60/542 |
| 3,983,788 | 10/1986 | Andersson et al. | 91/46 |
| 4,812,109 | 3/1989 | Yonezawa | 91/313 X |

FOREIGN PATENT DOCUMENTS

| | | | |
|---|---|---|---|
| 875179 | 4/1953 | Fed. Rep. of Germany . | |
| 151180 | 11/1980 | Japan | 417/403 |
| 380194 | 11/1975 | Sweden . | |

*Primary Examiner*—Leonard E. Smith
*Attorney, Agent, or Firm*—Jeffrey H. Ingerman

[57] ABSTRACT

A fluid driven linear motor with a piston (4) in a cylinder (5) is supplied with driving fluid under the control of a sliding valve device (8) having a slide (9) being moved between its terminal positions and being retained therein by means of the driving fluid. A pilot rod (22) connected to the piston (4) controls the supply of driving fluid to the respective sides of the slide (9). The pilot rod (22) is slidingly received in a cavity (12) in the slide and has sections (23–25) of reduced diameter which act as valves in certain positions.

7 Claims, 3 Drawing Sheets

Fig. 5
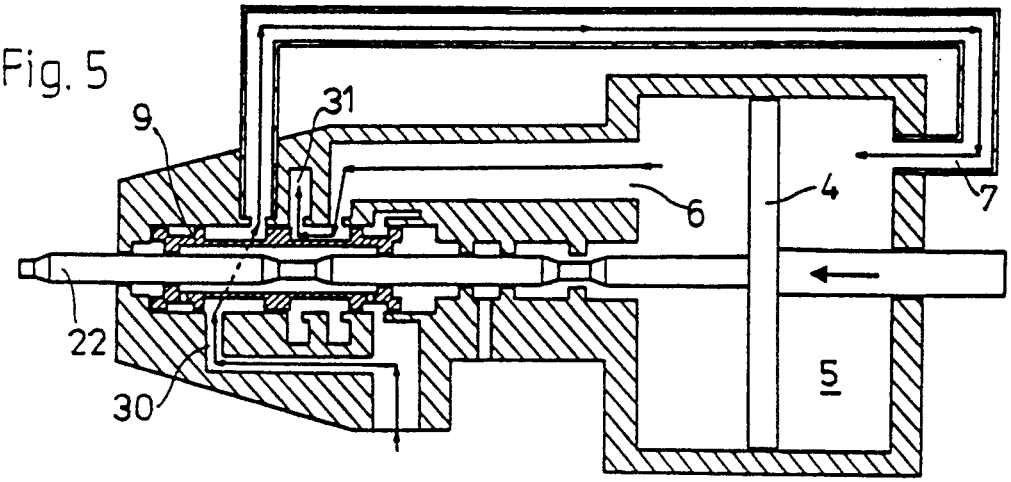
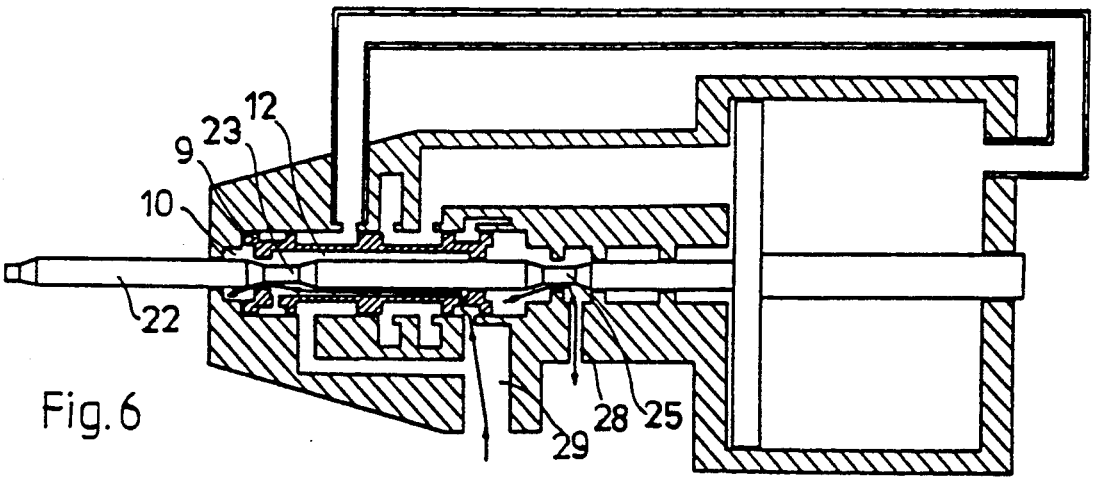
Fig. 6

METHOD AND AN ARRANGEMENT FOR CONTROLLING A LINEAR MOTOR present invention relates to an arrangement for the control of a fluid driven linear motor comprising a cylinder and a piston in which the two opposite sides of the piston are alternately supplied with fluid from a slide valve device.

Such linear motors may be used for driving for instance pumps for high pressure washing machines, water jet cutting, injection and dosage of chemicals, hydraulic systems, or for pumping most types of liquids and gases.

In a previously known linear motor of the type mentioned above, the turning of the piston takes place when a spring-loaded mechanical device pushes the slide to its opposite position for the purpose of reversing the movement of the piston. This mechanical device also comprises a spring-loaded toggle mechanism which is necessary in order to retain the slide at each terminal position. The structure of the previously known linear motor is very complicated because of its many moving parts, and therefore correspondingly costly to manufacture, and besides, the rate of the stroke of the motor is restricted because of the comparatively large mass of the piston system. The piston system further contains parts which can move axially among themselves, partly because of play and partly from the effect of springs, and this also gives rise to additional vibrations and accompanying noise.

From German Patent Specifiction 875 179 a linear motor is known where the slide has an axially extending chamber wherein a pilot device is movable between two terminal positions in time with the movements of the piston. The pilot device also has an axially extending cavity and both the slide and the pilot device have radial ports so that driving fluid can be conveyed through some of these radial ports and the axial cavity of the pilot device to one or the other of the end surfaces of the slide depending upon the relative positions of the slide and the pilot device. In order to move the slide from one of its terminal positions to the other, it is first necessary to shift the pilot device inside the slide. This is done by means of separate end bolts protruding externally of the valve housing and being activated through some mechanism by the piston. Due to unavoidable clearance between the various parts in the pilot device activating mechanism and the fact that the pilot device must be shifted against the full driving fluid pressure, the stroke rate or speed of the motor is severely restricted, the noise level and wear rate is high, while the efficiency is not at an optimum.

The aim of the present invention is to provide an arrangement of the type mentioned initially which makes it possible to achieve a quicker stroke rate in the linear motor and at the same time makes its structure simpler, less costly and more reliable.

This is achieved according to the invention by an arrangement in a fluid driven linear motor, for instance for operating a high pressure pump, comprising a cylinder and a piston. The two opposite sides of the piston are supplied with driving fluid from a slide valve device. The slide valve device has a slide which is moved between its terminal positions under the effect of a pilot device which is moved synchronously with the movements of the piston. The slide has an axially continuous cavity in which the pilot device is slidingly received and arranged to alternately bring the cavity into fluid communication with the ends of the slide when the piston is at its terminal positions. The slide further has means for supplying driving fluid to the cavity. The cavity of the slide at its axially separated ends is provided with inwardly protruding seals which interact with the pilot device. The pilot device has a first section of reduced cross section which opens the cavity towards the ends of the slide when it is in a position opposite one or the other of the seals.

By arranging the slide and pilot device in this manner, rapid and reliable shifting of the position of the slide is achieved without the need to use appreciable force or a complicated, noisy and costly mechanism which could wear or would have springs which might sag. The rate of stroke of the motor may be increased in order thereby to yield improved performance for the same size and weight, and the increased rate of stroke, moreover, will also make it easier to dampen the noise from the driving fluid let out by the motor if this is e.g. compressed air.

To further the understanding of the invention it will be described below with reference to the exemplifying embodiment shown in the attached drawings.

FIGS. 3–6 are schematic sections through the motor of FIG. 1 which illustrate the various stages of its control.

Figure 1:
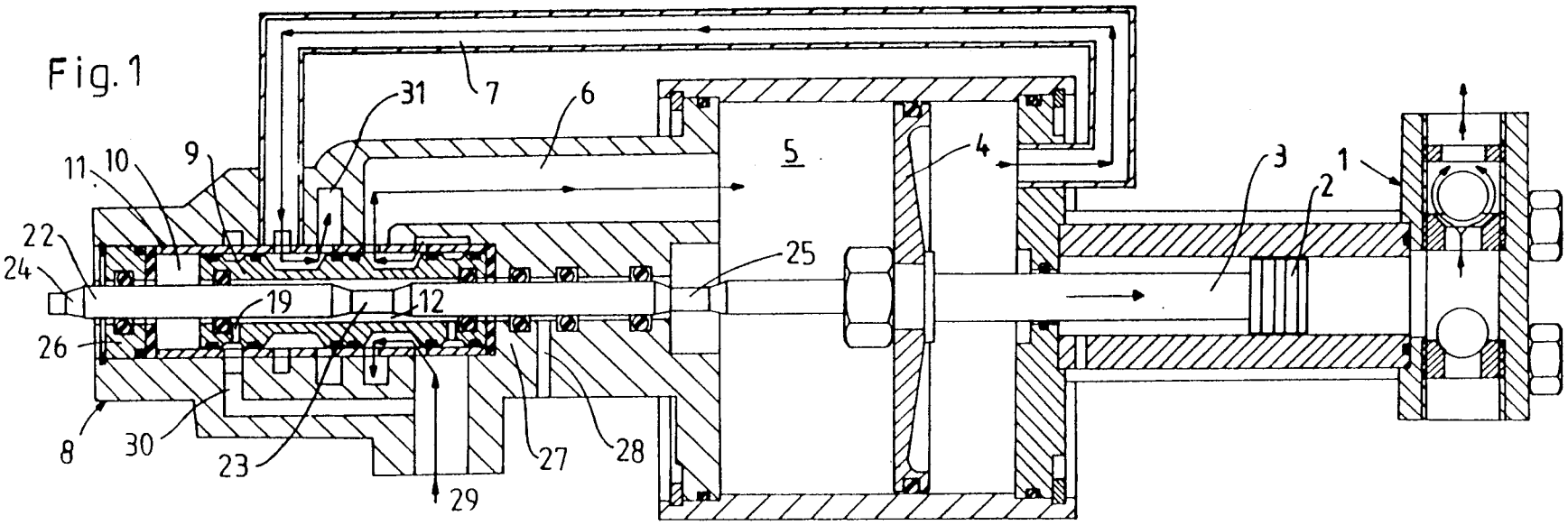
FIG. 1 shows an axial section through a high pressure pump driven by means of a linear motor controlled according to the invention.

In FIG. 1 is shown a high pressure pump, generally designated by 1. This comprises a high pressure piston 2, connected to a piston rod 3. Connected to the piston rod 3 is a driving piston 4 which, together with a cylinder 5, constitute the working parts of the linear motor. Through ducts 6 and 7 driving fluid is alternately added to and let out of the drive cylinder 5.

Control of the flow of the driving fluid in the ducts 6 and 7 is obtained by means of a sliding valve device generally designated by 8. It comprises a slide 9, arranged slidingly in a slide chamber 10. The cylinder wall of the slide chamber is formed by a slide chamber sleeve 11, in which port openings are provided at mutually correct positions opposite to the various ducts of the sliding valve device.

Figure 2:
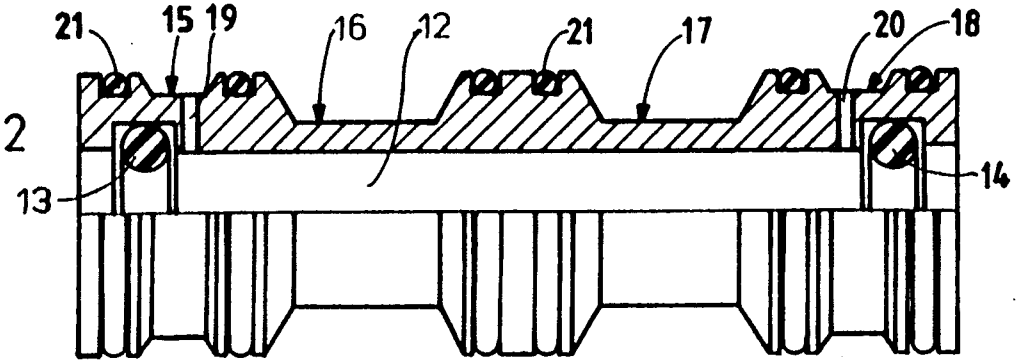
FIG. 2 shows in larger scale and partial section a slide for use in the linear motor of FIG. 1.

As will be further evident from FIG. 2, the slide 9 is equipped with an axially continuous cavity 12 which at its ends is terminated by means of a seals, 13, 14. On its outside the slide has four sections of reduced diameter, designated 15, 16, 17, and 18, respectively. The middle two of these, 16 and 17, are active when driving fluid is added to and let out of the cylinder 5, while the outer two, 15 and 18, assist in supplying driving fluid to the internal cavity 12 of the slide, as will be explained in greater detail below. For this purpose, these sections are provided with radial bores 19 and 20. The sections of reduced diameter 15–18 are all confined by means of O-rings 21.

Reference is again made to FIG. 1. A pilot rod 22 is fixedly connected to the piston rod in its continuation on the side opposite to the driving piston 4. The pilot rod will be glidingly received into the axially continuous cavity 12 of the slide 9, the diameter of the pilot rod and the seals 13 and 14 being adapted to each other so as to close the cavity 12 at its ends. The pilot rod 22 has an initial section 23 of reduced diameter. The length of this section is somewhat greater than the stroke of the slide 9, and the diameter is smaller than the internal diameter of the end seals 13 and 14 of the slide, so that when the section 23 is opposite to one or the other of these seals 13, 14, the internal cavity 12 of the slide will be open at the corresponding end of the slide.

The pilot rod 22 is also provided with a second and a third section of reduced diameter, described respectively as 24 and 25. These sections will in a similar manner form openings past the seals in the end walls 26, 27 of the slide 9, when the piston 4 and thus the pilot rod 22 are at their terminal positions. In the case of the end wall 26, the slide chamber 10 will be open directly to its ambient surroundings, while as far as the end wall 27 is concerned, it will be open to its ambient surroundings by means of a duct 28.

FIG. 1 illustrates the linear motor according to the invention in the middle of a stroke. The direction of movement of the various parts and the driving fluid are indicated by arrows. The driving fluid is supplied to the slide valve device 8 through an inlet duct 29. It will be seen that this inlet duct has an internal side branch 30. The driving fluid flows from the inlet duct 29 through openings in the slide chamber sleeve 11 into a cavity defined by the slender section 17 of the slide 9 and out through openings in the sleeve 11 to the duct 6 and onwards to the drive cylinder 5 on the left-hand side of the piston 4. Driving fluid from the cylinder 5 on the right-hand side of the piston is forced out through the duct 7, through holes in the sleeve 11 into a cavity defined by the slender section 16 of the slide and through further holes in the sleeve 11 into an exhaust duct 31 leading to an appropriate place according to the application of the linear motor and the type of driving fluid employed.

The slide 9 which, during the movement of the piston 4 to the right, is in its right-hand position, has its slender section 15 placed opposite to the side branch 30 of the inlet duct for the driving fluid. Consequently, this communicates with the internal cavity 12 of the slide through the bore 19 in the slide.

Figure 3:
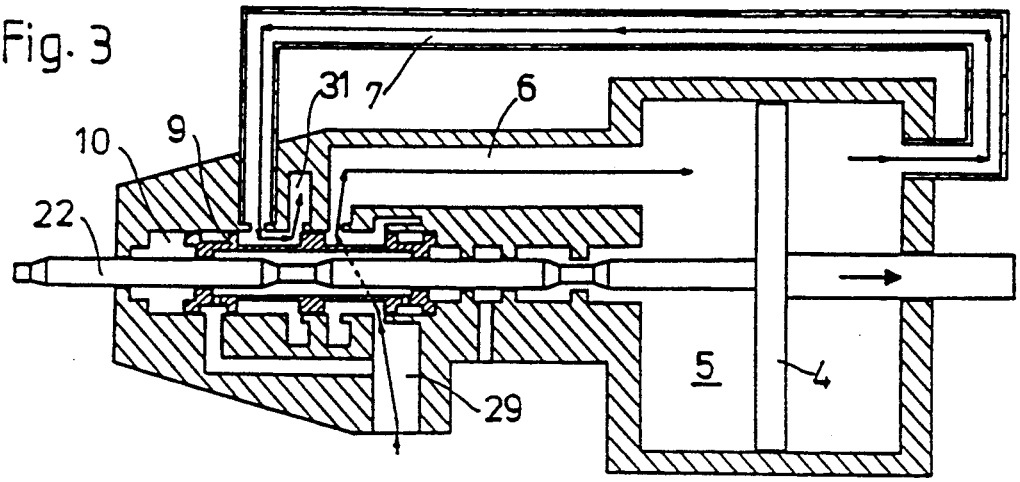

How the linear motor further works will be explained in greater detail with reference to FIG. 3–6. Here, FIG. 3 illustrates the same situation as FIG. 1.

Figure 4:
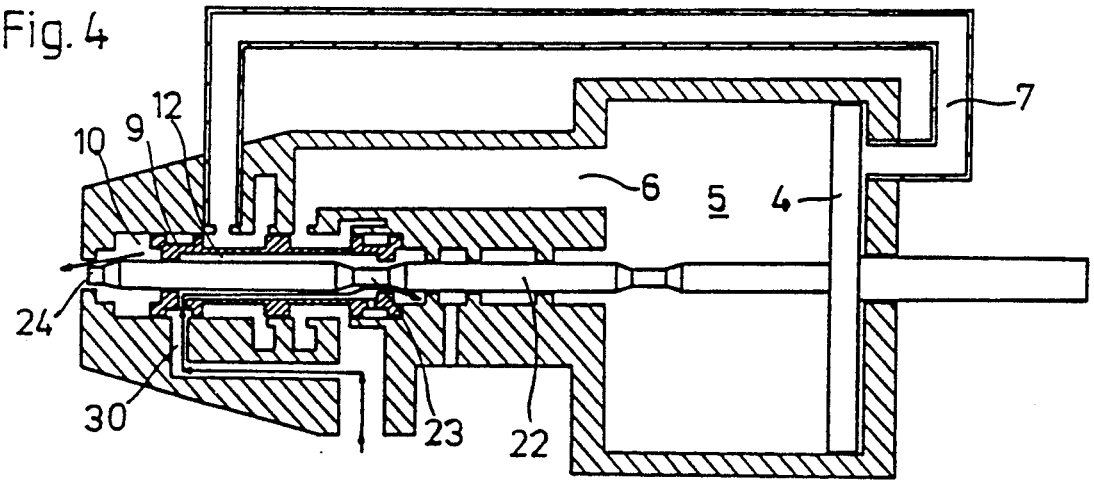

In FIG. 4 the piston 4 has arrived at its right-hand terminal position. This causes the slender section 23 of the pilot rod 22 to be positioned opposite to the seal 14 at the right-hand end of the slide 9. Consequently, flow communication is established between the cavity 12 of the slide and the right-hand end of the slide chamber 10, so that this is pressurized by the driving fluid. At the same time, the slender section 24 of the pilot rod 22 is in a position opposite to the seal in the end wall 26 of the slide chamber, so that an opening is created here which vents the left-hand end of the slide chamber 10 to the ambient surroundings. As indicated by the arrows in FIG. 4, driving fluid is supplied to the right-hand end of the slide chamber, to create a pressure against the right-hand end of the slide, forcing the slide to the left. While the slide makes this movement, driving fluid is constantly being supplied via the cavity 12 of the slide. During the initial part of the movement of the slide, the cavity 12 has driving fluid added through the bore 19 and the side branch 30, while during the latter part of the movement, the supply will be through the bore 20 in the slide and the inlet duct 29. For this purpose, the distance between the holes in the sleeve 11 of the slide chamber opposite to the inlet duct 29 and the side branch 30 is approximately equal to the distance between the outermost slender sections 15 and 18 of the slide 9. The left-hand side of the slide chamber 10 will be open during the entire movement of the slide to the left so that no resistance of pressure is created here, and because the slender section 23 of the pilot rod 22 is somewhat longer than the stroke of the slide, full pressure of driving fluid will exist on the right-hand side of the slide, even after the slide has completed its movement.

When the slide has arrived at its left-hand position as shown in FIG. 5, the direction of flow has been reversed in the ducts 6 and 7. The piston 4 and the pilot rod 22 will move towards the left. The movement of the pilot rod causes the cavity 12 of the slide to close again at both ends, so that the pressure built up on the right-hand side of the slide remains trapped and ensures that the slide is retained in its left-hand position until the piston 4 has reached its left-hand position.

This situation is illustrated in FIG. 6. Here the third slender section 25 of the pilot rod 22 has arrived at a position opposite to the seal in the end wall 27 of the slide chamber, so that the left-hand end section of the slide chamber 10 is vented through the duct 28. At the same time, the first slender section 23 is in a position opposite to the seal 13 in the left-hand end of the slide. This entails that driving fluid is added through the inlet duct 29, the bore 20 and the internal cavity 12 of the slide to the left-hand end section of the slide chamber 10, the end wall 26 of which is now closed to its surroundings by the pilot rod 22. The pressure being built up on the left-hand side of the slide thereby forces it towards the right, so that the situation as described in FIG. 3 is again reached, after which the cycle is repeated.

It will be appreciated that the invention is not restricted by the working example shown and described, but that it may be modified and varied in a number of ways within the scope of the claims below.

I claim:

1. An arrangement in a fluid driven linear motor, for instance for operating a high pressure pump (1), comprising a cylinder (5) and a piston (4) the two opposite sides of which are being supplied with driving fluid from a slide valve device (8) having a slide (9) which is moved between its terminal positions under the effect of a pilot device (22) which is moved synchronously with the movements of the piston (4), the slide (9) being provided with an axially continuous cavity (12) in which said pilot device (22) is slidingly received and arranged to alternately bring the cavity (12) in fluid communication with the ends of the slide (9) when the piston (4) is at its terminal positions, the slide (9) further being provided with means (15, 19–21) for the supply of driving fluid to the cavity (12), characterized in that the cavity (12) of the slide (9) at its axially separated ends is provided with inwardly protruding seals (13, 14) which interact with the pilot device (22), and that the pilot device (22) has a first section (23) of reduced cross section which opens the said cavity (12) towards the ends of the slide when it is in a position opposite one or the other of the seals (13, 14).

2. An arrangement according to claim 1 characterized in that the end walls (26, 27) of the chamber (10) of the slide (9) have seal-equipped openings which also receive the pilot device (22) slidingly, and that the pilot device (22) has a second and a third section (24, 25) of reduced cross section designed to vent the chamber (10)

of the slide (9) through the said openings when they are in position opposite to these in the respective terminal positions of the pilot device (22).

3. An arrangement according to claim 1 or 2, characterized in that the length of the said first section (23) of reduced cross section is somewhat greater than the stroke of the slide (9).

4. An arrangement according to claims 1 or 2, characterized in that the pilot device (22) comprises a rod having substantially constant diameter, said rod having reduced diameter sections constituting said sections (23, 24, 25) of reduced cross section.

5. An arrangement according to claim 4, characterized in that the rod is axially aligned with said piston (4) and is fixed thereto.

6. An arrangement according to claims 1 or 2, characterized in that the slide (9) is provided with at least four axially arranged sections (15–18) separated by seals (21) and of reduced outer diameter, the outer two of which (15, 18) are provided with some (19, 20) of the said means for supplying driving fluid to the cavity (12) of the slide (9).

7. An arrangement according to claim 6, characterized in that the chamber (10) of the slide (9) is provided with inlet openings for driving fluid in two axially separated areas (29, 30), the distance between these areas being approximately equal to the distance between the outermost two sections (15, 18) of reduced diameter of the slide.

* * * * *

UNITED STATES PATENT AND TRADEMARK OFFICE

CERTIFICATE OF CORRECTION

PATENT NO. : 5,173,036

DATED : December 22, 1992

INVENTOR(S) : Tron-Halvard Fladby

It is certified that error appears in the above-indentified patent and that said Letters Patent is hereby corrected as shown below:

Title page, item [54] and column 1, line 2, delete "METHOD AND"

Column 1, line 5, before "present" should be inserted -- The --;

line 32, "Specifiction" should be -- Specification --.

Column 2, line 50, "a" should be deleted; "seals," should be -- seals --; "14." should be -- 14, respectively. --.

Column 5, claim 4, line 1, "claims" should be -- claim --.

Column 6, claim 6, line 1, "claims" should be -- claim --.

Signed and Sealed this

Twenty-ninth Day of March, 1994

*Attest:*

*Attesting Officer*

Bruce Lehman

BRUCE LEHMAN

*Commissioner of Patents and Trademarks*